United States Patent [19]

Carssow

[11] Patent Number: 4,707,938

[45] Date of Patent: Nov. 24, 1987

[54] REMOTE CONTROL PRICE CHANGING SIGN

[76] Inventor: John F. Carssow, 12124 Drujon La., Dallas, Tex. 75244

[21] Appl. No.: 874,238

[22] Filed: Jun. 13, 1986

[51] Int. Cl.[4] ..... G09F 11/295

[52] U.S. Cl. ..... 40/471; 40/518

[58] Field of Search ..... 40/471, 518, 117

[56] References Cited

U.S. PATENT DOCUMENTS

| | | | |
|---|---|---|---|
| 1,067,483 | 7/1913 | Murphy | 40/471 |
| 1,283,165 | 10/1918 | Hanigsman | 40/518 |
| 1,547,033 | 7/1925 | Crawford | 40/518 |
| 2,095,401 | 10/1937 | Smith | 40/471 |
| 2,563,580 | 8/1951 | Clark | 40/518 |
| 2,935,806 | 5/1960 | Young | 40/471 |
| 3,009,275 | 11/1961 | Rosenberg | 40/152.1 |
| 3,582,937 | 6/1971 | Ratcliffe | 40/471 |
| 3,616,554 | 11/1971 | Singer | 40/471 |
| 4,373,279 | 2/1983 | Abel | 40/10 R |

FOREIGN PATENT DOCUMENTS

| | | | |
|---|---|---|---|
| 530961 | 10/1921 | France | 40/471 |
| 723601 | 1/1932 | France | 40/518 |

*Primary Examiner*—Henry E. Raduazo

*Attorney, Agent, or Firm*—Warren H. Kintzinger

[57] ABSTRACT

A large sign mounted high on a supporting pole, tower or building is provided with changeable figure sections. Each changeable figure section includes an upper motor driven roller and a lower motor driven roller and an elongate panel of flexible material having digits 0 to 9 thereon with opposite ends of the panel fixed to and rollable on the respective rollers. A three wire motor control system is provided for each changeable figure section that extends therefrom to the ground and on to a remote location with a two way switch where the operator can watch the sign changes he is making. This makes it easier and safer for a person to change letters and numbers on billboards that are dangerous and/or inaccessable to climb up on and work on particularly with a sign high in the air facing the elements.

16 Claims, 11 Drawing Figures

REMOTE CONTROL PRICE CHANGING SIGN

Figure 1:
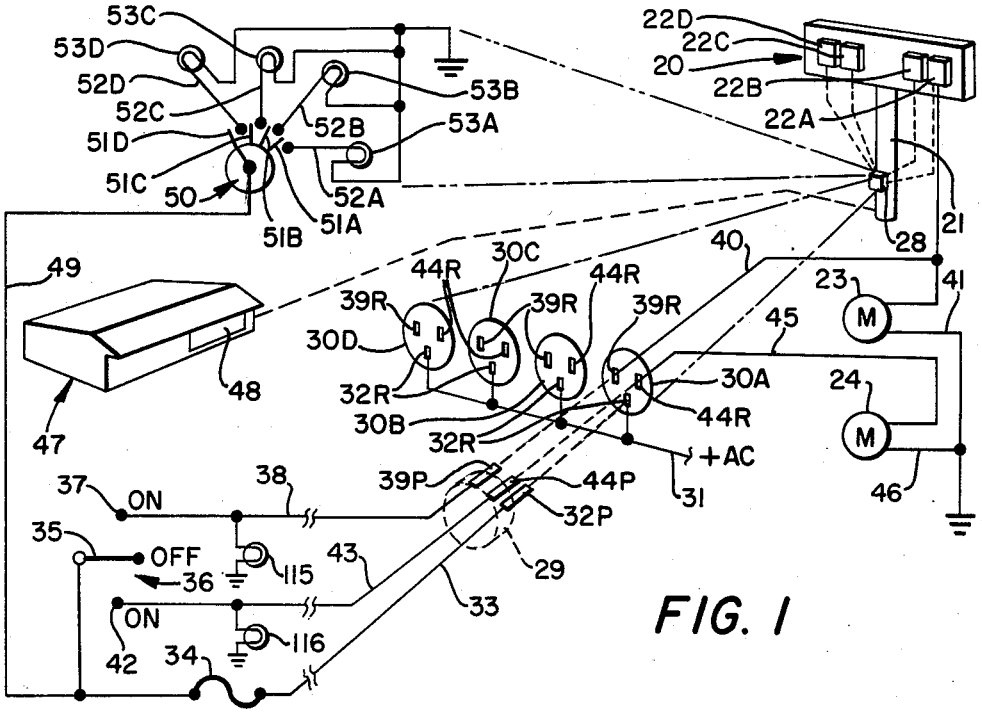

This invention relates in general to changeable signs, and more particularly, to large signs such as billboards having changeable figure sections controllable from remote locations not requiring that a person climb a sign tower or pole to make the periodically required sign changes.

Billboard signs generally extend to substantial heights and are exposed to all the elements in an inaccessable and dangerous, particularly if proper care is not exercised, environment. Such work requires experienced, competent people for any work up on the sign at relatively high pay even if it is only to change prices indicated on the sign. This is not only time consuming but also expensive and, from a human welfare standpoint, the requirement for a person to climb a sign and endanger his or her life should be minimized. Changeable figure sections for billboard signs have included cumbersome flip over multi-plate or plaque structure that is not only difficult to mount being heavy and complex but also expensive both initially and in service maintainance requirements. Other window shade type structures have been used but these require a multiplicity of number shades 0–9, a control selecting system, and pull structure for each of the 0–9 numbered shades. Obviously many of these various structures are heavy and bulky presenting all kinds of installation problems and maintainance problems.

It is, therefore, a principal object of this invention to provide a price changing sign structure for billboards that is easy and safe for a person to change letters and numbers on billboards from the ground.

Another object is to provide such a price changing sign structure that minimizes the requirement for one's climbing up a billboard tower to dangerous heights and/or relatively inaccessable tower positions.

A further object is to provide such a price changing structure that is relatively inexpensive yet highly reliable in operation.

Still another object is to provide such a price changing structure electrically driven with power on only during manually actuated periods of price number or letter changing.

Features of the invention useful in accomplishing the above objects include, in a changeable figure (numbers or letters) section equipped billboard sign with the sections individually controlled from a remote location, a plurality of changing figure sections each including an upper motor driven roller and a lower motor driven roller and an elongate panel of flexible material having digits 0 to 9 thereon with opposite ends of the panel fixed to and rollable on the respective rollers. A three wire motor control system is provided for each changeable figure section that extends therefrom to the ground and on to a remote location with a two way switch where the operator can watch the sign changes he is making. This makes it easier and safer for a person to change letters or numbers on billboards that are dangerous and/or inaccessable to climb up on and work on particularly with a sign high in the air facing the elements.

A specific embodiment representing waht is presently regarded as the best mode of carrying out the invention is illustrated in the accompanying drawings.

Figure 2:
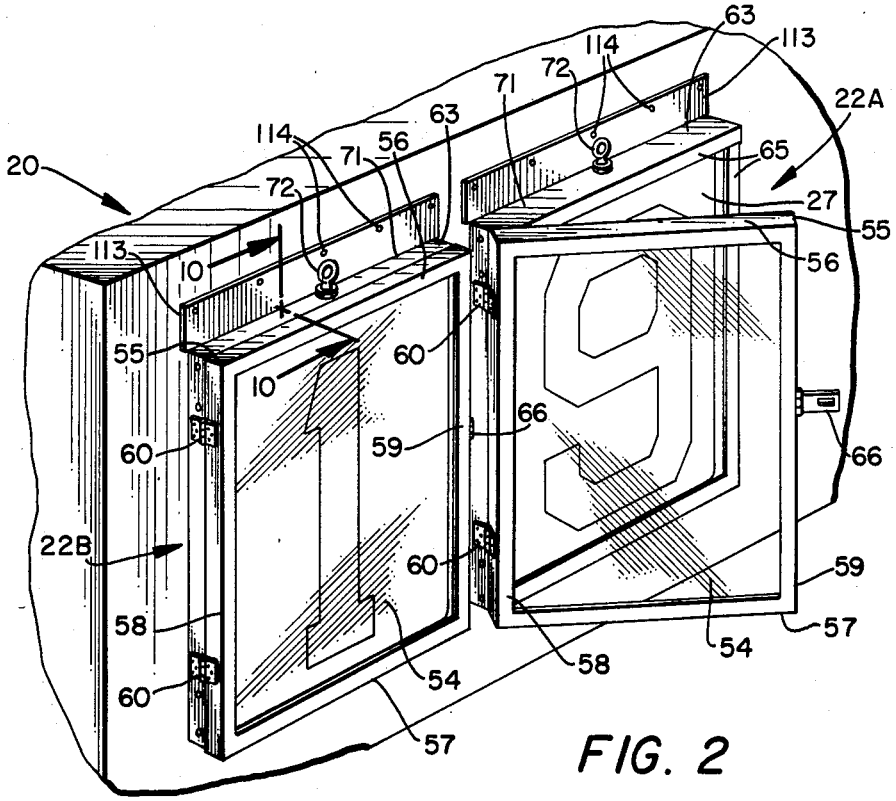
Figure 3:
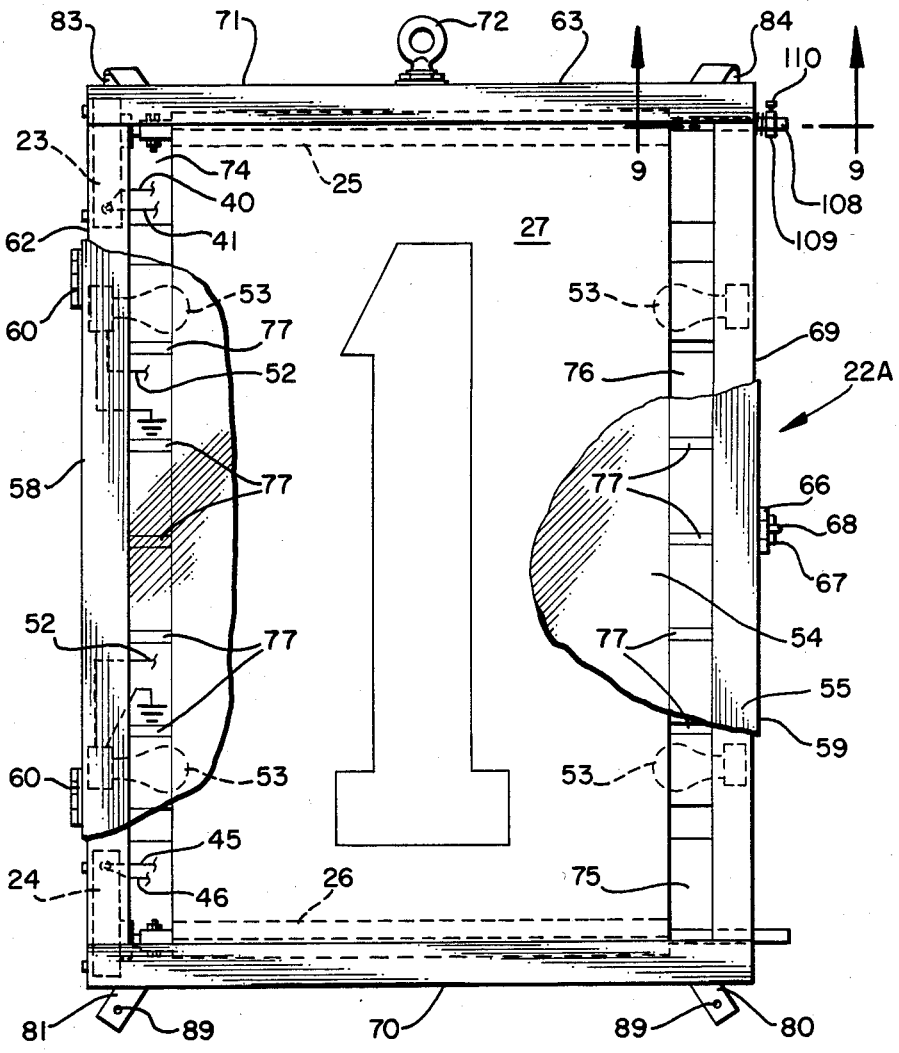

In the drawings:

FIG. 1 represents a perspective and expanded schematic showing of a sign changeable number section equipped billboard with its remote control system;

FIG. 2, a partial perspective view of a billboard sign showing two changeable numbered sections mounted thereon;

FIG. 3, a front elevation view of a changeable number section with portions of the front cover broken away to more clearly show interior detail.

Figure 4:
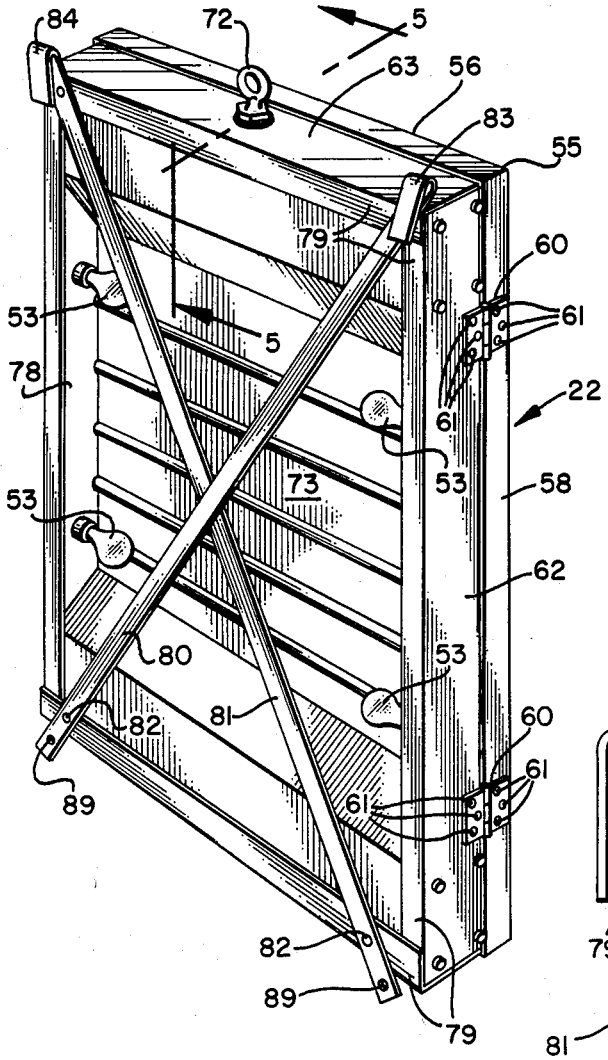
Figure 5:
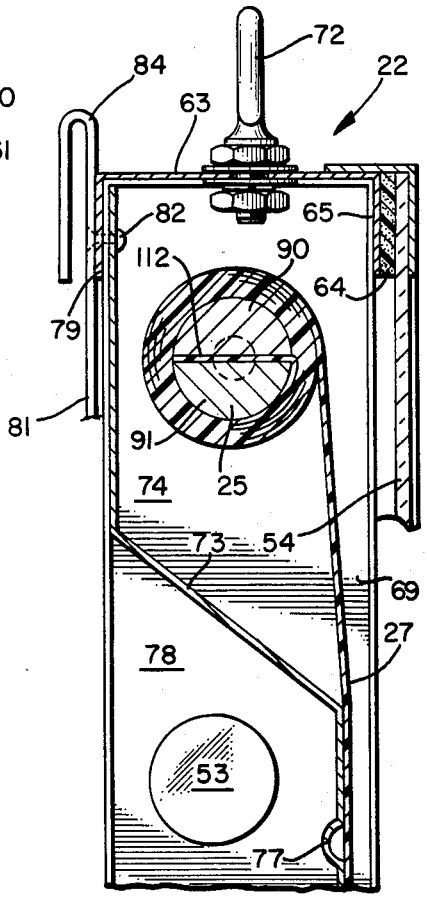
Figure 6:
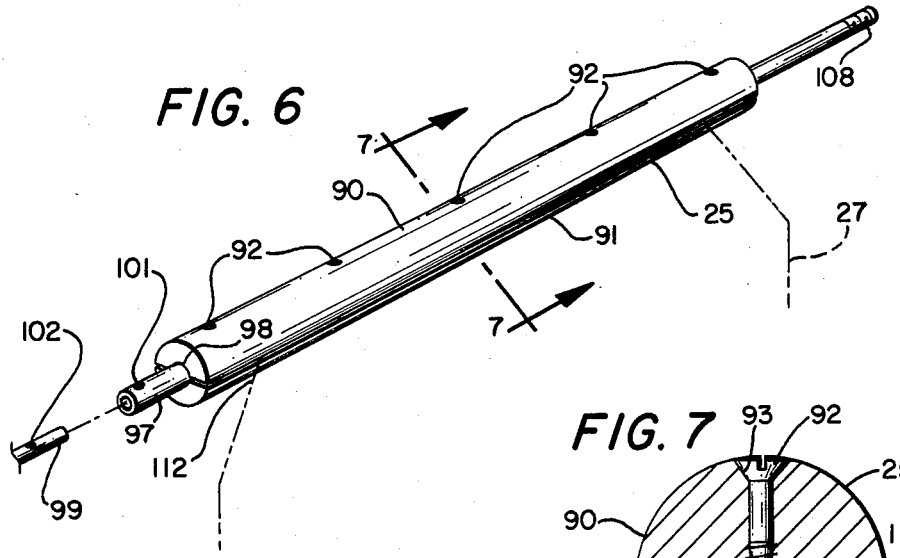
Figure 7:
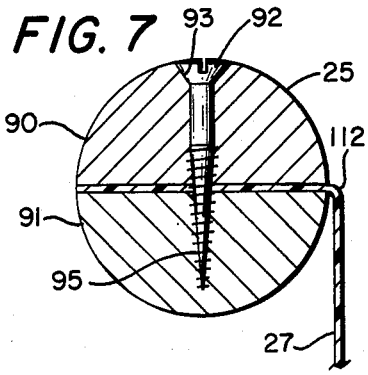
Figure 8:
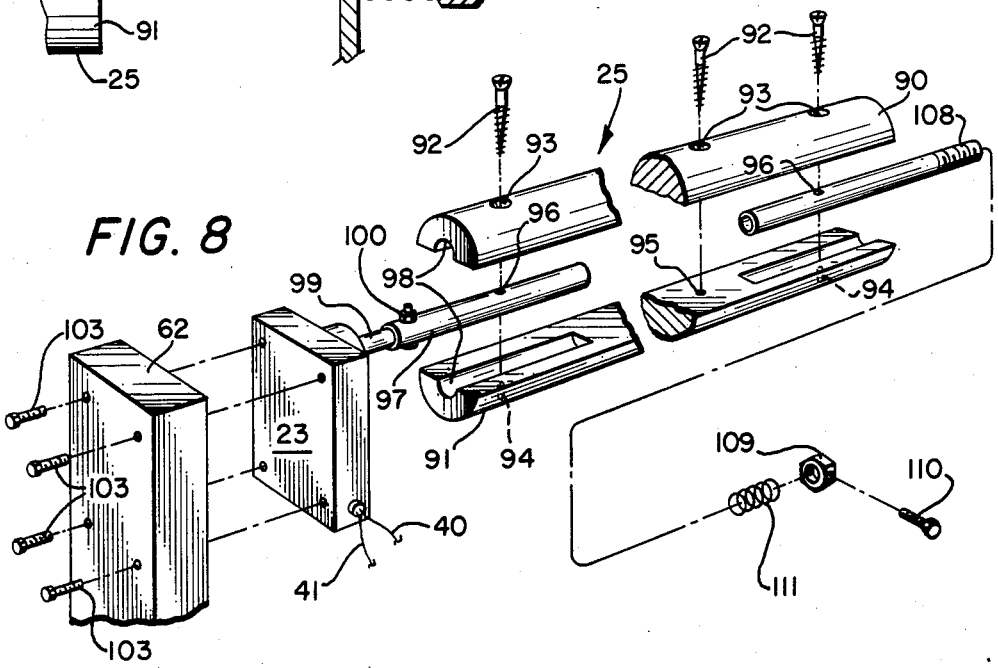

FIG. 4, a rear perspective view showing back interior detail of a changeable number section of FIGS. 2 and 3;

FIG. 5, a partial broken away and sectioned side elevation view taken along line 5—5 of FIG. 4;

FIG. 6, a perspective view of a flexible material panel roller with the motor drive shaft disengaged therefrom;

FIG. 7, a broken away and sectioned view of the roller taken along line 6—6 of FIG. 6 showing detail of the roller mounting a flexible material panel;

FIG. 8, an exploded perspective view of the flexible material panel roller of FIGS. 6 and 7 also including the drive motor therefore and motor mounting detail.

Figure 9:
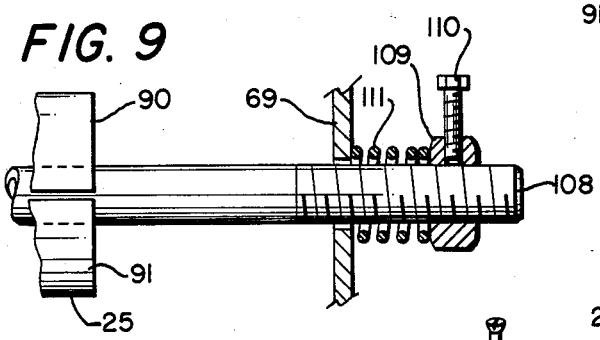
Figure 10:
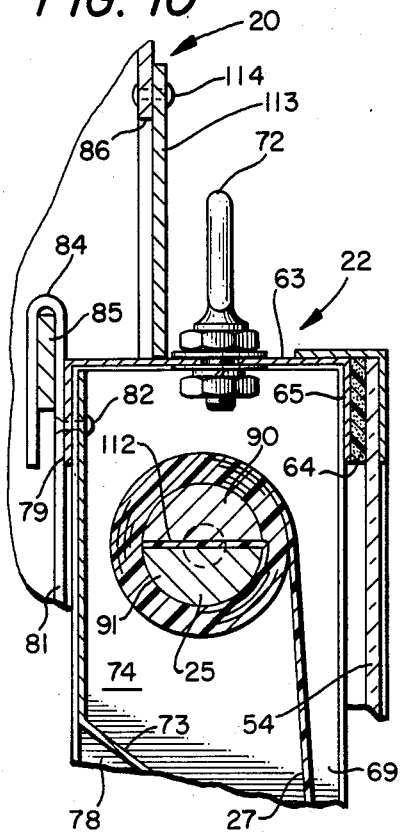
Figure 11:
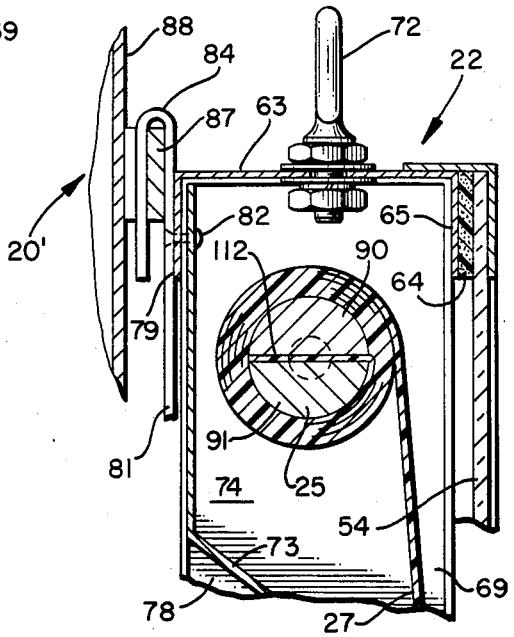

FIG. 9, a partial end view of the roller opposite the motor driven end mounting detail;

FIG. 10, a partial broken away and sectioned side elevation view taken along line 10—10 of FIG. 2 showing partial mounting detail of a changeable number section; and, FIG. 11, a partial broken away and sectioned side elevation view like that of FIG. 10 showing partial mounting detail of a changeable number section on a face of a billboard. Referring to the drawings:

The billboard sign 20 of FIG. 1 is shown to be mounted on a pole (or tower) 21 and to be equipped with four letter or number changeable sections 22A, 22B, 22C and 22D. Each of the number changeable sections 22 has an upper motor 23 and a lower motor 24, referring also to FIGS. 2 and 3, that are operated to drive upper and lower rollers 25 and 26, respectively, running an elongate panel 27 of flexible material having digits 0 to 9 thereon up or down. A control and plug connection box 28 is mounted low on pole 21 so as to be readily accessable from the ground in order that a three prong plug 29 may be selectively plugged into one of four three connection receptacles 30A, 30B, 30C and 30D. An AC line 31 is connected to each connection 32R of the receptacles 30A, 30B, 30C and 30D and when a plug 29 is plugged into a receptacle, such as indicated for receptacle 30A, plug prong 32P extends through line 33 to a remoted location and through fuse 34 to the switch arm 35 of momentary switch 36. The switch arm 35 may be manually switched to upper contact 37 to feed AC through line 38, plug prong 39P, receptacle connection 39R and line 40 to upper motor 23 that has a connection through line 41 to ground. When switch arm 35 is manually switched to lower contact 42 AC is fed through line 43, plug prong 44P, receptacle connection 44R and line 45 to lower motor 24 that has a connection through line 46 to ground. This provides for running numbered (0–9) flexible material panel 27 up or down in changing price numbering. This is accomplished with one or the other of motors 23 and 24 being powered to run its roller 25 or 26 and the other of motors 23 and 24 dragging without power as an aid to keeping the flexible material panel 27 taut and without wrinkles during price changing. The lines 33, 38 and 43 may be relatively long lines so that the momentary switch 36 is at a location where the person controlling price changes on the sign sections 22A, 22B, 22C and 22D views the sign from an appropriate viewing distance for proper positioning of the panels 27 in making desired price changes. The momentary switch 36 could be located in a building 47 with a view of the sign 20 through a window 48 as a convenience in remote position sign changing control. An AC line 49 may be provided extending from connection of fuse 34 with switch arm 35 to a timer 50 that may be turned on to a desired time to shut-off. Timer 50 is shown to have four output switches 51A, 51B, 51C, and 51D connected to lines 52A, 52B, 52C, and 52D that are extended to heater elements 53A, 53B, 53C, and 53D, that may be a light bulb 53 or a plurality of light bulbs 53 in parallel in a section 22 with the other sides connected to ground. With this structure the timer could be located with switch 36 at a remote location for control convenience when ice may form in the sign sections 22. Switch 36 is a momemtary switch to insure that it is never left on to burn out a motor 23 or 24 and the timer 50 is provided to insure that power to any of the heater elements 53A, 53B, 53C and 53D is on for only a limited time with each setting to the on state.

As shown in FIGS. 2, 3, 4 and 5 each number chargeable section 22 is provided with a transparent front window unit 54 within a rectangular frame 55 of "L" shaped top and bottom, left and right side framing members 56, 57, 58 and 59, respectively. A pair of hinges 60 are connected as by screws or rivets 61 to the left side frame member 62 of the section 22 box 63 and to the left side frame member 58 of window unit 54. Weather seal material 64 is mounted on the inside of the front lip of "L" shaped framing members 56, 57, 58 and 59 in position to bear against in sealing fashion the front face of box 63 rectangular front opening defining lipping 65 when a window unit 54 is closed and locked with the hasp 66 pinned 67 to loop member 68 mounted on the right side frame member 69 of box 63. Each section 22 box 63 also includes a bottom frame member 70 and a top frame member 71 with an eye bolt 72 mounted thereon for lifting of number changeable sections 22 in mounting them on billboard signs or removing them from signs.

A front to back barrier member 73 that extends from top to bottom and from side to side within section 22 box 63 is formed with a transverse chamber 74 at the top for roller 25 and roller drive motor 23 and a transverse chamber 75 at the bottom for roller 26 and roller drive motor 24. Between chambers 74 and 75 member 73 is formed forwardly to present a guide surface 76 for the flexible material elongate panel 27. The panel 27 guide surface 76 projects forward far enough to provide continous backing support for the panel 27 whatever degree of roll up on either of the rollers 25 and 26. The panel 27 in number changing movement slides over surface 76 with transverse grooves 77 provided therein as an aid to letting air under the panel and to minimize sticking of the panel to surface 76. A pattern of raised rounded projection could be used in place of transverse grooves 77 in accomplishing substantially the same thing. Heater elements 53 in the form of light bulbs are contained within the chamber 78 defined by member 73 behind panel guide surface 76 as an aid to unfreezing ice that may have formed from condensation within the unit during cold weather to overcome any freezing of the panel 27 to the guide surface 76. A hot air blower or heater strips could be used in place of the light bulbs as heating elements. At the rear of the box 63 the side frame members 62 and 69 and top and bottom frame members 71 and 70 have rear lipping 79 to the rear of which crisscross frame and mount straps 80 and 81 are fastened as by rivets 82. The tops of mount straps 80 and 81 are formed with looped over ends 83 and 84 that may fit over a transverse sign frame member 85 for sections 22 that are inserted into openings 86 in a sign provided therefor as shown in FIG. 10. As an alternate, as shown in FIG. 11, the looped over ends 83 and 84 may fit over a transverse sign frame member 87 for mounting of sections 22 on the face 88 of a billboard sign 20'. The bottom ends of mount straps 80 and 81 extend below the bottoms of respective letter or number changeable sections 22 and are provided with holes 89 for further securing of the sections 22 in place on a sign with screws.

Referring now also to FIGS. 6, 7, 8 and 9 the construction of rollers 25 and 26 are substantially the same so the description of an upper roller 25 and its mounting should suffice for both. Roller 25 is primarily a round elongate roller of wood split longitudinally from end to end into two halves 90 and 91 that are assembled together with screws 92 through openings 93 in roller half 90 extended on into openings 94 and 95 in roller half 91. The left end screw 92 also extends through opening 96 in drive shaft extension 97, that is received in opening 98 of roller 25, and receives shaft 99 as an extension into the tubular extension 97. Drive shaft 99 and tubular extension 97 are pinned together by bolt assembly 100 extended through opening 101 in extension 97 and opening 102 in drive shaft 99. The drive shaft 99 is the drive output of motor 23 that is mounted to the inside top of left side frame member 62 by bolts 103. The right end screw 92 also extends through opening 104 in tubular mount member 105 that is received in opening 106 of roller 25 and extends outwardly through opening 107 in right side frame member 69 from which it receives bearing support. Tubular mount member 105 terminates at its outer end in threads 108 which receive a nut 109, with a set screw 110, that encloses a coil compression spring 111 between the nut 109 and the right side frame member 69. The nut 109 may be adjusted on threads 108 to vary the compression of spring 111 and the drag of roller 25 imposed by the non-activated motor 23 along with the drag created via spring 111 in keeping the flexible material panel 27 taut when the panel 27 is being pulled down by roller 26 as driven by motor 24. The flexible material panel 27 has tapered down in width ends 112 to extend into the rollers 25 and 26 between the roller halves 90 and 91 without interfering with the tubular extension 97 and tubular mount member 105. It should be noted that with an installation such as shown in FIGS. 2 and 10 that an opening top closure plate 113 may be riveted (or bolted) 114 in place on the sign face above each unit 22.

Referring again to FIG. 1 it should be noted that an "ON" indicator light 115 is connected between line 38 and ground, and an "ON" indicator light is connected between line 43 and ground. These are provided at the momentary switch 36 control station in order that the operator of the switch 36 can see that power is appearing on the line the switch is thrown to.

Whereas this invention has been described with respect to several embodiments theereof, it should be realized that various changes may be made without departure from the essential contributions to the art made by the teachings hereof.

I claim:

1. A changeable figure section for an elevated sign controllable from a remote location comprising: a changeable figure section in a rectangular box structure having a transparent front window; an upper roller and a lower roller rotatably mounted in the top and the bottom of said rectangular box structure; an upper and a lower motor in said box structure drive connected to said upper and lower rollers respectively; an elongate panel of flexible material having a series of figures along the forward face thereof and upper and lower ends fastened to said upper and lower rollers, respectively, and windable on said upper and lower rollers to varying degrees in advancing the panel up and down to different figure displaying positions with the upper roller driven to draw the panel up when the upper roller is power driven by said upper motor and to draw the panel down when the lower roller is power driven by said lower motor; power supply means for said upper motor and power supply means for said lower motor; control means line connected for individually controlling power fed to said upper and lower motors from a remote location; wherein mounting means is connected to said rectangular box structure for the mounting of said box structure on an elevated sign, such as a tower mounted billboard; said mounting means is in the form of criss-cross frame members fastened to the back of said rectangular box structure by fastening means; and with said criss-cross frame members formed with hooks at the top for support from a sign transverse frame member, and bottom ends extended beyond the bottom of said box structure for additional mount fastening to the sign.

2. The changeable figure section for an elevated sign controllable from a remote location of claim 1, wherein said figure section box structure is inserted in an opening in the sign sized to receive said box structure.

3. The changeable figure section for an elevated sign controllable from a remote location of claim 1, wherein said figure section box structure is mounted on the front face of said elevated sign.

4. The changeable figure section for an elevated sign controllable from a remote section of claim 1, wherein a plurality of said figure section box structures is mounted on the front face of said elevated sign.

5. A changeable figure section for an elevated sign controllable from a remote location comprising: a changeable figure section in a rectangular box structure having a transparent front window; an upper roller and a lower roller rotatably mounted in the top and the bottom of said rectangular box structure; an upper motor and a lower motor in said box structure drive connected to said upper and lower rollers respectively; an elongate panel of flexible material having a series of figures along the forward face thereof and upper and lower ends fastened to said upper and lower rollers, respectively, and windable on said upper and lower rollers to varying degrees in advancing the panel up and down to different figure displaying positions with the upper roller driven to draw the panel up when the upper roller is power driven by said upper motor and to draw the panel down when the lower roller is power driven by said lower motor; power supply means for said upper motor and power supply means for said lower motor; and control means line connected for individually controlling power fed to said upper and lower motors from a remote location; wherein said box structure includes top and bottom opposite side box defining members; a baffle member spanning the box structure from top to bottom and from side to side within said top and bottom and opposite side box defining members with forward opening upper and lower roller containing chambers and an interim forward flexible panel backing forward projection positioned for the panel to slide along in figure changing movement thereover; said interim forward projection of said baffle member defining a rear enclosure of said changeable figure section encloses heating element means used to defrost any frozen moisture on the baffle member tending to freeze said flexible panel to said baffle member; and wherein said baffle member is provided with surface deformations to counter baffle surface fluid condensate adhesion sticking of said flexible panel to the forward surface of said baffle member as an aid to free movement of said flexible panel thereover.

6. The changeable figure section for an elevated sign controllable from a remote location of claim 5, wherein said surface deformations in said baffle member are transverse grooves extending from side to side thereof.

7. The changeable figure section for an elevated sign controllable from a remote location of claim 5, wherein said heating element means is in the form of light bulbs.

8. The changeable figure section for an elevated sign controllable from a remote location of claim 5, wherein said heating element means is circuit connected to ground location turn off turn on control means.

9. The changeable figure section for an elevated sign controllable from a remote location of claim 8, wherein said heating element means turn off turn on control means includes automatic timer turn off means.

10. The changeable figure section for an elevated sign controllable from a remote location of claim 5, wherein said flexible panel is formed with opposite end tabs that are fastened to said upper and lower rollers.

11. The changeable figure section for an elevated sign controllable from a remote location of claim 10, wherein said opposite end tabs of said flexible panel are insert fastened between said roller halves of said split upper and lower rollers.

12. The changeable figure section for an elevated sign controllable from a remote location of claim 5, wherein said control means for individually controlling power fed to said upper and lower motors from a remote location includes a return to off switch that is manually thrown and held to apply power to upper motor power line means and to lower motor power line means with only one of the two motors being power driven at a time.

13. The changeable figure section for an elevated sign controllable from a remote location of claim 12, wherein the line connections from said return to off switch is a three line remote location to said changeable figure section; with one line on AC power supply line and the other two lines individual switch connected lines to said upper and lower drive motors.

14. The changeable figure section for an elevated sign controllable from a remote location of claim 13, wherein first on indicator light means is connected from the control switch power line to the upper roller drive motor to ground; and second on indicator light means is connected from the control switch power line to the lower roller drive motor to ground; and with said first and second on indicator light means located for viewing at the control switch location.

15. The changeable figure section for an elevated sign controllable from a remote location of claim 12, wherein drag imposing means is included with each of said upper and lower rollers in addition to the drag imposed on a roller by the motor of that roller when the other roller is being power driven by the motor of that roller.

16. The changeable figure section for an elevated sign controllable from a remote location of claim 15, wherein said drag imposing means is a coil spring and a spring compression adjustment nut threaded on a roller shaft end with the coil spring adjusted against a box side frame member.

* * * * *